US007874441B2

(12) United States Patent
Bloom et al.

(10) Patent No.: US 7,874,441 B2
(45) Date of Patent: Jan. 25, 2011

(54) CLOSURE AND PACKAGE FOR HIGH-TEMPERATURE APPLICATIONS

(75) Inventors: Kenneth S. Bloom, Bloomdale, OH (US); Stephen A. Eilertson, Perrysburg, OH (US); Wendell D. Willingham, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 999 days.

(21) Appl. No.: 11/711,927

(22) Filed: Mar. 1, 2007

(65) Prior Publication Data

US 2008/0210657 A1 Sep. 4, 2008

(51) Int. Cl.
*B65D 45/00* (2006.01)

(52) U.S. Cl. ..... 215/276; 220/254.7; 215/350

(58) Field of Classification Search ..... 220/254.7, 220/787, 789, 325; 215/276, 349, 350, 351
See application file for complete search history.

(56) References Cited

U.S. PATENT DOCUMENTS

| | | | | |
|---|---|---|---|---|
| 2,619,246 | A | 11/1952 | Staller | |
| 4,019,646 | A | 4/1977 | Imamura | |
| 4,433,790 | A | 2/1984 | Gibson | |
| 4,747,500 | A | 5/1988 | Gach et al. | |
| 4,813,561 | A | 3/1989 | Ochs | |
| 6,591,998 | B2 | 7/2003 | Haynes et al. | |
| 6,874,647 | B2 | 4/2005 | Bloom et al. | |
| 7,147,118 | B2 | 12/2006 | Bloom et al. | |
| 2004/0099629 | A1 | 5/2004 | Whitley | |
| 2004/0108294 | A1 * | 6/2004 | Bloom et al. | 215/276 |
| 2005/0098529 | A1 | 5/2005 | Bloom et al. | |

FOREIGN PATENT DOCUMENTS

| | | | |
|---|---|---|---|
| GB | 2244040 A | * | 11/1991 |
| WO | WO 9404422 A1 | * | 3/1994 |

OTHER PUBLICATIONS

Notification of Transmittal of The International Search Report and The Written Opinion for International Application No. PCT/US2008/002641, mailed Jun. 4, 2008.
International Search Report for International Application No. PCT/US2008/002641, mailed Jun. 4, 2008.
Written Opinion of the International Searching Authority for International Application No. PCT/US2008/002641, mailed Jun. 4, 2008.

* cited by examiner

*Primary Examiner*—Athony Stashick
*Assistant Examiner*—James N Smalley
(74) *Attorney, Agent, or Firm*—Reising Ethington PC

(57) ABSTRACT

A plastic closure includes a plastic closure shell having a base wall with a central opening and a skirt for securing the closure to a container neck finish. A plastic disk includes angularly spaced fingers extending into the central opening of the shell base wall and external beads on the fingers for engaging an inner periphery of the central opening to retain the disk within the shell. The beads have flat undersurfaces and the inner periphery of the central opening has a ledge with a conical surface engaged by the beads. Any doming that occurs in the disk and/or the closure shell base wall increases the surface contact between the finger beads and the opposing surface of the ledge so that removal of the shell from a container neck finish will simultaneously lift and remove the disk from the neck finish without having the beads snap through the central opening in the shell so that the shell is removed while the disk is retained on the neck finish.

9 Claims, 3 Drawing Sheets

20
22
40
42
38
2
2
26

38
40
42
44
46
32
22
20
39
50
3
36
30
34
28
24
26

49
51
42
40
48
44
32
22
38
39
50
46
30
32
24

CLOSURE AND PACKAGE FOR HIGH-TEMPERATURE APPLICATIONS

The present disclosure is directed to a plastic closure for beverage, food, juice, pharmaceutical and like applications, and more particularly to a closure and a package that are particularly well suited for high-temperature (e.g., pasteurization, hot fill, asceptic fill and retort) applications.

BACKGROUND AND SUMMARY OF THE DISCLOSURE

U.S. Pat. Nos. 6,874,647 and 7,147,118 disclose a closure, a package and a method of assembling and filling a package that are particularly well adapted for high-temperature applications. Such high-temperature applications include, for example, applications in which the container is filled with product while the product is hot, such as so-called hot fill and asceptic fill applications. High-temperature applications also include applications in which the filled package is subjected to pasteurization or retort after filling. During retort applications, for example, the filled package can be subjected to a temperature of 265° F. for 15 minutes. High-temperature applications also can occur when a package is filled with a carbonated beverage and subjected to storage under high-temperature conditions, in which the internal pressure within the container can increase dramatically. In all of such high-temperature situations, the container closure is subjected to elevated internal pressure, which tends to distort or dome the closure and interrupt the seal between the closure and the container neck finish.

The noted patents disclose a plastic closure that includes a plastic closure shell having a base wall with a central opening and a skirt with at least one internal thread segment or at least one internal bead for securing the closure to a container neck finish. A plastic disk is retained within the shell. The disk includes a plurality of axially extending spacer elements around the disk to engage the undersurface of the shell base wall and space the disk from the base wall of the shell, and angularly spaced fingers extending from the disk through a central opening in the shell base wall to retain the disk within the shell. A resilient liner may be disposed on an underside of the disk for sealing engagement with the container neck finish.

The present disclosure embodies a number of aspects that can be implemented separately from or in combination with each other.

A plastic closure in accordance with one aspect of the present disclosure includes a plastic closure shell having a base wall with a central opening and a skirt for securing the closure to a container neck finish. A plastic disk includes angularly spaced fingers extending into the central opening of the shell base wall and external beads on the fingers for engaging an inner periphery of the central opening to retain the disk within the shell. The beads have flat undersurfaces and the inner periphery of the central opening has a ledge with a conical surface engaged by the beads. Any doming that occurs in the disk and/or the closure shell base wall increases the surface contact between the finger beads and the opposing surface of the ledge so that removal of the shell from a container neck finish will simultaneously lift and remove the disk from the neck finish without having the beads snap through the central opening in the shell so that the shell is removed while the disk is retained on the neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figures 1, 2, 3:
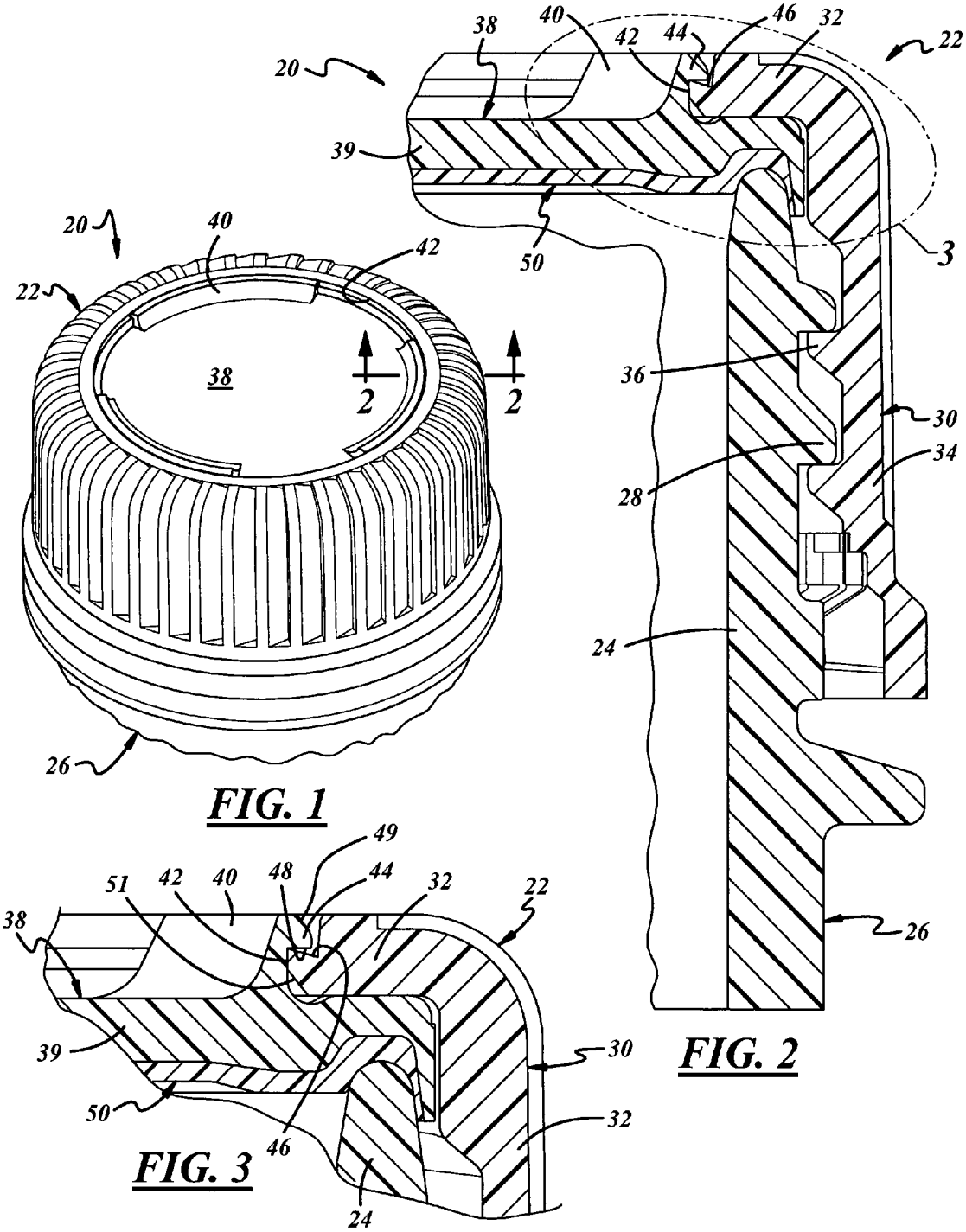
FIG. 1 is a fragmentary perspective view of a package in accordance with an exemplary embodiment of the present disclosure.
FIG. 2 is a fragmentary sectional view taken substantially along the line 2-2 in FIG. 1.
FIG. 3 is a fragmentary sectional view on an enlarged scale of the portion of FIG. 2 within the area 3.

FIGS. 1-3 illustrate a package 20 in accordance with a first exemplary embodiment of the present disclosure as including a plastic closure 22 secured to the neck finish 24 of a container 26. Neck finish 24 has one or more external thread segments or external beads 28. (The term "thread segments" is employed in its usual broad sense to include both continuous and discontinuous thread segments, and to include both single and multiple threads.) Container 26 can be of glass or plastic construction.

Closure 22 includes a plastic shell 30 having a base wall 32 and an annular skirt 34. Skirt 34 has one or more internal thread segments or internal beads 36 by means of which closure 22 is secured to container neck finish 24. A plastic disk 38 has a disk body 39 from which angularly spaced fingers 40 extend through a central opening 42 in shell base wall 32. Each finger 40 has an external bead 44 received by snap fit over an internal ledge 46 around the inner periphery of central opening 42 and by means of which disk 38 is retained on shell 30. The undersurfaces 48 of beads 44 are flat and preferably lie in a common plane. This common plane preferably is perpendicular to the central axis of disk 38. Beads 44 preferably also have conical surfaces 49 facing radially outwardly and axially away from disk body 39. The upper surface of ledge 46 is conical, facing away from the central axis of closure shell 30. In the event of doming of disk 38 and/or shell base wall 32 under pressure within the package, surfaces 46,48 are brought into enhanced surface engagement. In this way, removal of shell 38 from container neck finish 24, such as by unthreading of the closure shell with respect to the neck finish, engages and lifts disk 38 from sealing engagement with the container neck finish. Flat undersurface 48 and conical ledge surface 46 help prevent fingers 40 from snapping through central opening 42 during such closure removal, which might otherwise occur if beads 44 were rounded. Finger conical surface 49 cooperates with a conical undersurface 51 around opening 42 to cam fingers 40 inwardly as disk 38 is assembled to shell 30.

Figure 4:
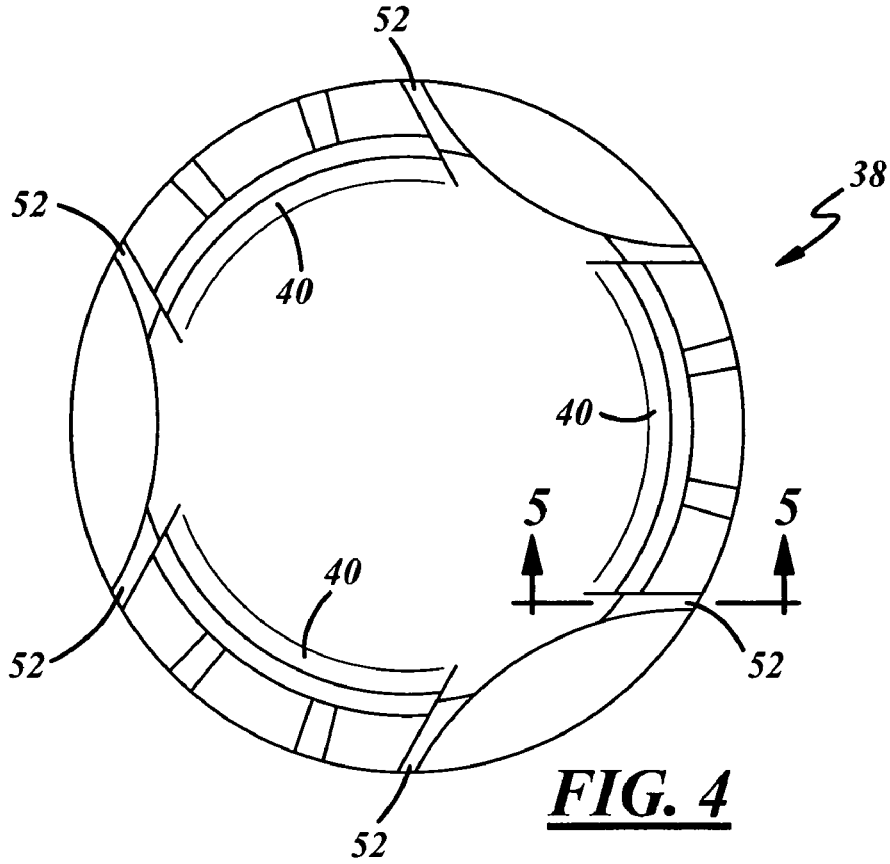
FIG. 4 is a top plan view of the sealing disk in the closure of FIGS. 1-3.
Figure 5:
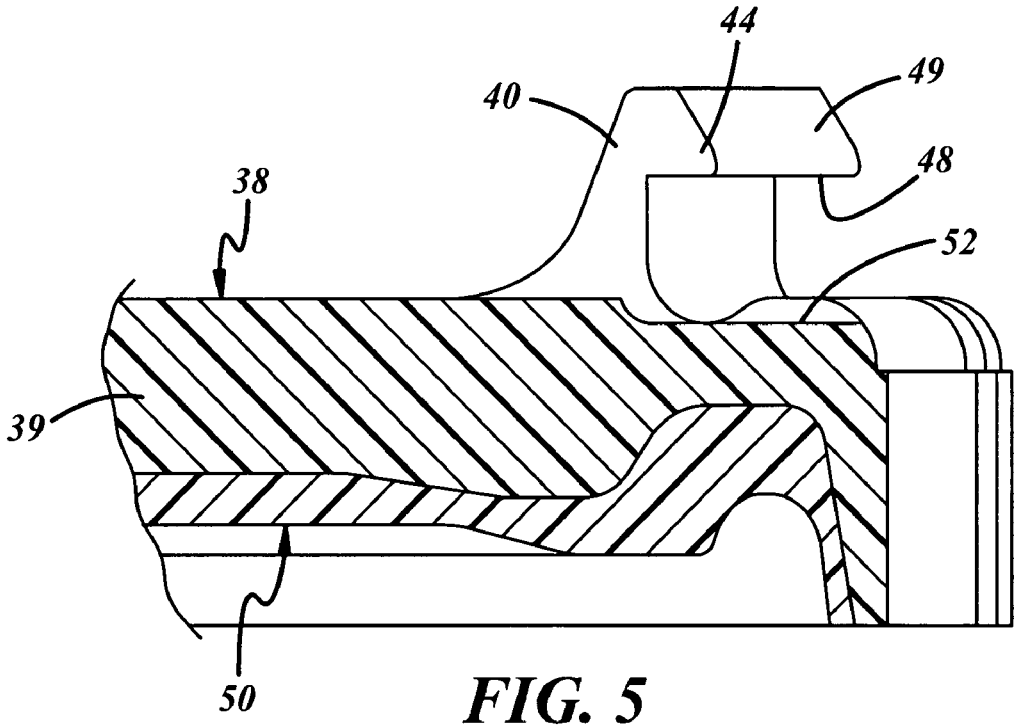
FIG. 5 is a fragmentary sectional view taken substantially along the line 5-5 in FIG. 4.

Disk 38 preferably has a flexible resilient sealing liner 50 on the undersurface of the disk body for sealing engagement with the end of container neck finish 24. Sealing liner 50 preferably is molded in situ on the undersurface of disk body 39, although liner 50 could be provided as a separate element and adhered to the undersurface of the disk body. Disk 38 preferably has channels 52 that extend from a position between fingers 40 to the outer periphery of disk 38, as best seen in FIGS. 4 and 5. Channels 52 preferably are molded into the upper surface of disk body 39. The central portion 56 of disk 38 within fingers 40 preferably is flat to allow for provision of user indicia either by being molded onto the disk or by being provided on a separate label that is secured to the disk. Ledge 46 closely overlies the end of neck finish 24 in the package of FIGS. 1-3. This arrangement provides enhanced sealing engagement with the end of neck finish 24.

Figure 6:
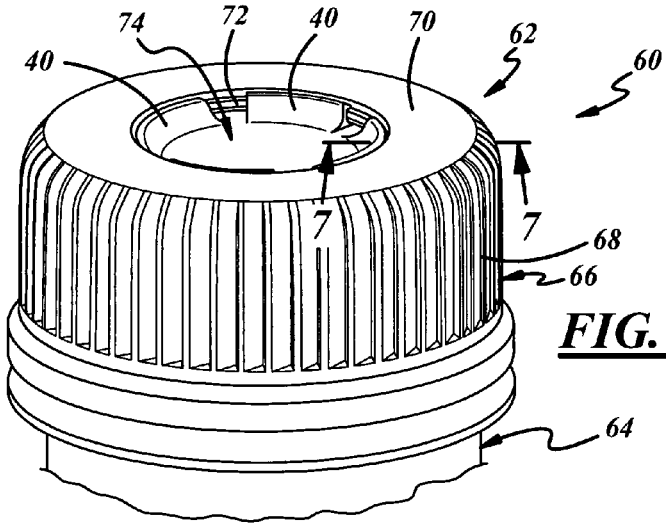
FIG. 6 is a fragmentary perspective view of a package in accordance with a second exemplary embodiment of the present disclosure.
Figure 7:
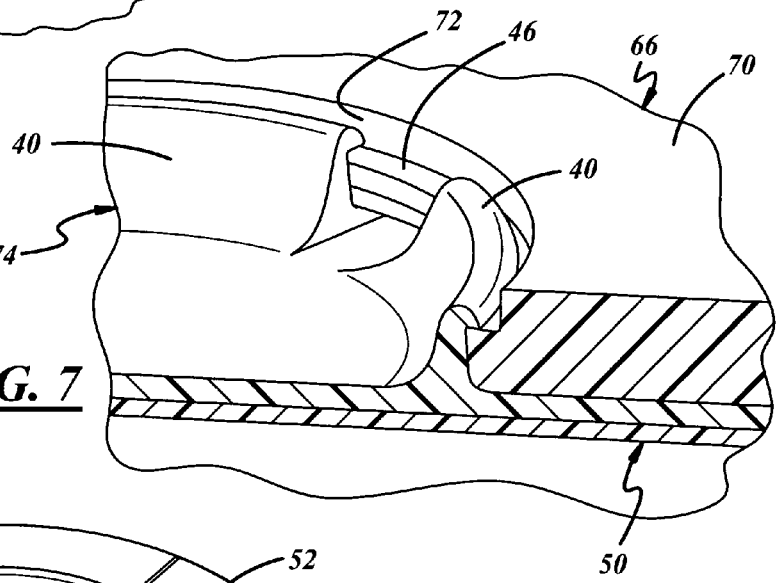
FIG. 7 is a fragmentary sectional view taken substantially along the line 7-7 in FIG. 6.
Figure 8:
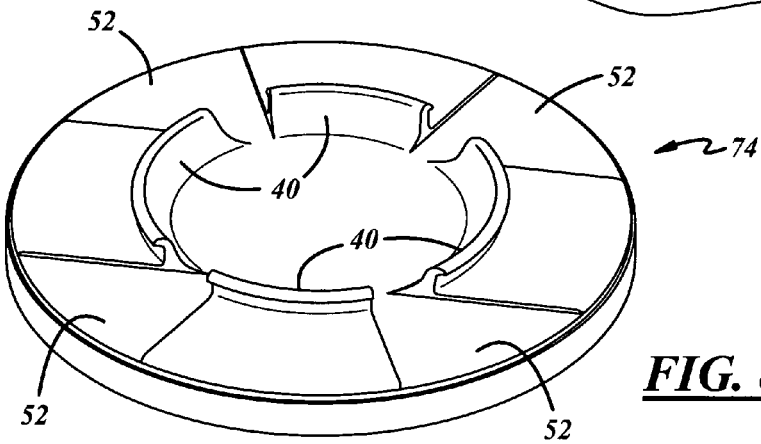
FIG. 8 is a perspective view of the sealing disk in the closure of FIGS. 6-7.

FIGS. 6-8 illustrate a package 60 in accordance with a second exemplary embodiment of the present disclosure. Elements in package 60 that are similar to those in package 20 of FIGS. 1-5 are indicated by correspondingly identical reference numerals. Package 60 includes a plastic closure 62 secured to the neck finish of a container 64. Closure 62 includes a plastic shell 66 having a skirt 68 and a base wall 70 with a central opening 72. A disk 74 has angularly spaced fingers 40 that are received by snap fit over a ledge 46 within opening 72. Channels 52 in disk 74 preferably are formed by recesses that widen from between fingers 40 to the peripheral edge of the disk. Channels 52 in both embodiments of the present disclosure provide for flow of flushing fluid, as disclosed in the above-noted U.S. patents.

The present disclosure thus provides a plastic closure, and a closure and container package, that are particularly well suited for high-temperature applications. The disclosure has been presented in conjunction with exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A plastic closure that includes:

a plastic closure shell having a base wall with a central opening and a skirt for securing the closure to a container neck finish, and a plastic disk including angularly spaced fingers extending into said central opening of said base wall and external beads on said fingers for engaging an inner periphery of said opening to retain said disk within said shell, wherein said beads have flat undersurfaces and said inner periphery of said central opening has a ledge with a conical surface engaged by said flat undersurfaces of said beads and facing away from a central axis of said shell to help prevent said fingers from snapping through said central opening during closure removal, wherein said disk has a surface opposed to said base wall and channels in said surface extending from between said fingers to a periphery of said disk.

2. The closure set forth in claim 1 wherein said disk includes a flexible resilient liner on an undersurface of said disk.

3. The closure set forth in claim 1 wherein said disk has a flat upper surface within said fingers.

4. The closure set forth in claim 1 wherein said flat undersurfaces of said beads lie in a common plane.

5. A retort package that includes:

a container having a neck finish and a closure received on said neck finish, said closure including:

a plastic closure shell having a base wall with a central opening and a skirt securing the closure to said container neck finish, and a plastic disk including angularly spaced fingers extending into said central opening of said base wall and external beads on said fingers engaging an inner periphery of said opening to retain said disk within said shell, said beads having flat undersurfaces and said inner periphery of said central opening having a ledge with a conical surface engaged by said flat undersurfaces of said beads and facing away from a central axis of said shell to help prevent said fingers from snapping through said central opening during closure removal, wherein said disk has a surface opposed to said base wall and channels in said surface extending from between said fingers to a periphery of said disk.

6. The package set forth in claim 5 wherein said disk includes a liner on an undersurface of said disk in sealing engagement with said neck finish.

7. The package set forth in claim 5 wherein said inner periphery of said central opening overlies an end of said neck finish.

8. The package set forth in claim 7 wherein said disk has a flat upper surface within said fingers.

9. The package set forth in claim 5 wherein said flat undersurfaces of said beads lie in a common plane.

* * * * *